US005767814A

United States Patent [19]

Conroy et al.

[11] Patent Number: 5,767,814

[45] Date of Patent: Jun. 16, 1998

[54] MAST MOUNTED OMNIDIRECTIONAL PHASE/PHASE DIRECTION-FINDING ANTENNA SYSTEM

[75] Inventors: Peter J. Conroy, Clarksville; Nathan D. Curry, Columbia, both of Md.; Derek R. Warner, Berwyn, Pa.

[73] Assignee: Litton Systems Inc., Woodland Hills, Calif.

[21] Appl. No.: 515,899

[22] Filed: Aug. 16, 1995

[51] Int. Cl.[6] ..... H01Q 13/00

[52] U.S. Cl. ..... 343/774; 343/893; 343/853; 343/844

[58] Field of Search ..... 343/774, 846, 343/893, 844, 845, 853, 834, 773, 829; 342/372; H01Q 13/00

[56] References Cited

U.S. PATENT DOCUMENTS

| | | | |
|---|---|---|---|
| 3,605,099 | 9/1971 | Griffith | 343/774 |
| 3,803,618 | 4/1974 | Coleman | 343/893 |
| 4,584,582 | 4/1986 | Munger | 343/845 |
| 4,962,383 | 10/1990 | Tresselt | 343/853 |
| 5,506,592 | 4/1996 | MacDonald et al. | 343/846 |

*Primary Examiner*—Hoanganh T. Le

*Attorney, Agent, or Firm*—Gerald L. Lett; Scott J. Coonan

[57] ABSTRACT

A direction finding antenna system includes a plurality of monopole elements disposed symmetrically around a center of a circular ground plane at the same radial distance from the center and a multimode combiner connected to the monopole elements to provide one or more mode outputs. A phase difference detector determines phase differences between selected ones of the mode outputs to provide azimuth bearing of a detected object. Typically, four or eight monopole elements are used. Placement of the inherently narrowband monopole elements in a bicone structure having a polarizer grid extends the useful bandwidth. Multiband coverage is achieved with a plurality of such antennas connected by a feed cable positioned on the polarizer grid to avoid interference.

61 Claims, 9 Drawing Sheets

| | ANTENNA PORTS | | | |
|---|---|---|---|---|
| | 1 | 2 | 3 | 4 |
| MODES | PHASE SHIFT IN DEGREES | | | |
| -1 | 0 | -90 | -180 | -270 |
| +1 | 0 | +90 | +180 | +270 |
| 0 | 0 | 0 | 0 | 0 |

| | ANTENNA PORTS | | | | | | | |
|---|---|---|---|---|---|---|---|---|
| | 1 | 3 | 5 | 7 | 2 | 4 | 6 | 4 |
| MODES | PHASE SHIFT IN DEGREES | | | | | | | |
| -2 | 0 | -180 | 0 | -180 | -90 | -270 | -90 | -270 |
| +2 | 0 | +180 | 0 | +180 | +90 | +270 | +90 | +270 |
| +1 | 0 | +90 | +180 | +270 | +45 | +135 | +225 | +315 |

MAST MOUNTED OMNIDIRECTIONAL PHASE/PHASE DIRECTION-FINDING ANTENNA SYSTEM

BACKGROUND OF THE INVENTION

The invention relates to antenna systems, and in particular to antenna systems used in direction finding (DF) applications.

Amplitude direction finding systems employ a plurality of antenna elements covering different geographically isolated sectors, such as quadrants. When signals are detected, the sector with the largest return is considered to indicate the direction of arrival of the target signal. Such amplitude direction finding systems suffer from limitations in direction finding accuracy, which make target location identification uncertain. Interferometer techniques have also been employed in direction finding applications. In interferometer systems, the angle of arrival is determined by comparing the phase relationships and the signals from separated antennas. Interferometric systems introduce ambiguities since phase difference measurements can indicate several possible directions of arrival. Thus, the ambiguities must be resolved. Multimode systems in which various antenna modes are examined have been used to resolve the ambiguities.

One antenna configuration used for direction finding is a multi-arm (four or more arms) planar spiral antenna. While this antenna works well above the horizon, its sensitivity at the horizon is often insufficient. In addition, the four arm spiral is a relatively complex system in which the reference phase of the spiral rotates and thereby requiring compensation in either software or hardware. U.S. Pat. No. 4,103,304, issued in 1973 and incorporated herein by reference discloses an antenna system in which a plurality of spiral antenna elements are connected to a mode forming network to resolve direction finding ambiguities. Such an antenna is necessarily large and expensive. In addition, the physical spacing of the relatively large spiral elements can result in errors in the far field.

Monopole elements placed closer together would reduce such far field errors. However, heretofore it has not been possible to employ monopole elements in a configuration that could be used in DF applications. Since monopole elements are not inherently broadband, the use of such monopole elements impose unacceptable bandwidth limitations.

Honey and Jones have reported a biconical direction finding system using a coaxial feed with a large metallic center post. The blockage caused by the center post causes large phase errors. In addition, Honey and Jones disclose the use of bandwidth limiting waveguide hybrids as combiners. Other previously employed multiple monopole element configurations have not used phase measurements to obtain other than coarse direction of arrival (DOA) information, such as DOA within 180 degrees (e.g., fore and aft).

SUMMARY OF THE INVENTION

In view of the performance limitations and complexities of conventional direction finding systems, it is an object of the invention to provide a broad band monopulse phase-phase system which provides accurate direction finding information over a wide range of frequencies.

It is still another object of the invention to employ a multi-element monopole system in which the phase difference between various modes yields a correspondence in phase angle versus spatial azimuth around the antenna.

It is still a further object of the invention to provide a biconical horn arrangement having greater gain than that available from conventional systems.

It is a still further object of the invention to provide monopole elements in such a biconical horn arrangement.

It is a further object of the invention to provide a biconical horn arrangement which is configured for sector only coverage.

It is still another object of the invention to provide response to both horizontal and vertical polarization.

It is still another object of the invention to provide a broad multi-band monopulse phase-phase system which can be configured in a multiple layer, wedding cake fashion.

It is still a further object of the invention to provide such an antenna system with at least some of the layers fed by a cable positioned with respect to the bicone to reduce interference.

It is a still further object of the invention to locate such a feed cable parallel to lines of a polarizer grid.

It is a still further objective to provide such an antenna system having an RMS phase error of less than 8° over a the field of view and over a frequency range of 0.5 GHz to 40 GHz.

It is a still further objective to provide such an antenna system with a gain typically of −8dBli at the output of a mode former and within a radome with a polarizer installed.

The above and other objects of the invention are achieved by an antenna system having a plurality of monopole elements disposed symmetrically about a center reference of a ground plane at a same radial distance from the center. A multimode combiner is connected to the monopole elements to provide a plurality of mode outputs. A phase difference detector is configured to determine phase differences between selected ones of the mode outputs in order to find the direction of a detected object.

For example, in a four element configuration, monopole elements are disposed at 0°, 90°, 180°, and 270° with respect to a ground plane, each of the monopole elements being the same radius from the center of a circle on the ground plane, (hereinafter the circular ground plane). A multimode combiner is connected to the monopole elements to provide a mode 0 output, a mode +1 output, and a mode −1 output. A phase difference detector is configured to determine the phase difference between a reference and one of the mode 1 and mode −1 outputs. The phase difference detector produces a correspondence of phase angle versus spatial azimuth around the antenna system. The reference can be the mode 0 output of the multimode combiner. The system according to the invention can also employ a central monopole element located at the center of the circular ground plane. The output from the central monopole element can also serve as the reference. As discussed further herein an eight element array can also be formed using eight monopole elements.

A system according to the invention can also be configured with bicone elements to form a biconical horn. Placement of the monopole elements inside the bicone produces a horn antenna effect, thereby allowing the monopole elements to operate over a broader bandwidth.

In another aspect of the invention, a multimode combiner is formed as a mode former having three 90° tandem couplers. The 0° and 90° monopole elements are connected to the first of the tandem couplers. Another of the tandem couplers receives an output from the 180° and 270° monopole elements. The output of the first tandem coupler is provided directly to one of the inputs of the third tandem coupler and the output of the second tandem coupler is provided to the second input of the third tandem coupler through a 90° phase shifter. According to the invention, the mode former is printed on a single low loss substrate and can be printed in a stripline arrangement such that the outputs of the elements do not cross over each other. This provides a broad frequency response to 40 GHz.

According to the invention, an antenna system can be formed with a plurality of vertically stacked antennas with each antenna having a pair of bicone elements and at least four feed elements disposed as previously discussed. A bicone feed element is provided and a mode former is connected to the feed elements to produce the desired mode outputs. Each of the plurality of antennas is configured to cover a different band of frequencies with the plurality covering, for example, a total band of about 0.5 GHz to 40 GHz.

BRIEF DESCRIPTION OF THE DRAWINGS

The invention is described in detail herein with reference to the drawings in which.

DETAILED DESCRIPTION OF THE PREFERRED EMBODIMENTS

An antenna according to the invention includes a plurality of monopole antenna elements in a circular array. Typically, the array has four or eight elements, although the invention applies to antennas with any number of monopole elements. Monopole elements can be spaced closer together than alternative notch and spiral antenna elements, thereby minimizing space requirements and reducing antenna phase errors attributable to the larger phase center separations required with large notch or spiral antenna elements. Monopole elements also provide higher gain and better phase performance than multiarm spirals in such applications. The monopole elements are connected to a mode forming network, such as a Butler matrix. Direct phase comparison of the output modes produces the azimuth bearing.

Since monopole elements are not inherently broadband, a horn antenna structure can be used to improve the operational bandwidth. The monopole element array according to the invention can be placed in a bicone structure, which acts as a horn and can be made to operate over a 3:1 bandwidth. A polarizer can also be employed. For example, a polarizer grid generating a slant 45 degree linear polarization can be used with the monopole array to permit both vertical and horizontal polarization reception.

Figure 1:
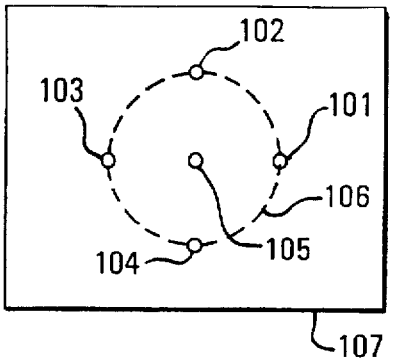
FIG. 1 shows an overall topology of antenna elements on a ground plane according to the invention.

FIG. 1 shows a topology for a circular monopole array according to the invention. As shown in FIG. 1, monopole antenna elements 101–104 are located symmetrically about a center 105 to form the generally circular pattern illustrated by dotted line 106. Antenna elements 101–104 are mounted on ground plane 107 to form the array. As discussed further herein, a five monopole array can be formed by placing an additional monopole antenna element at center 105, shown in FIG. 1.

Figure 2:
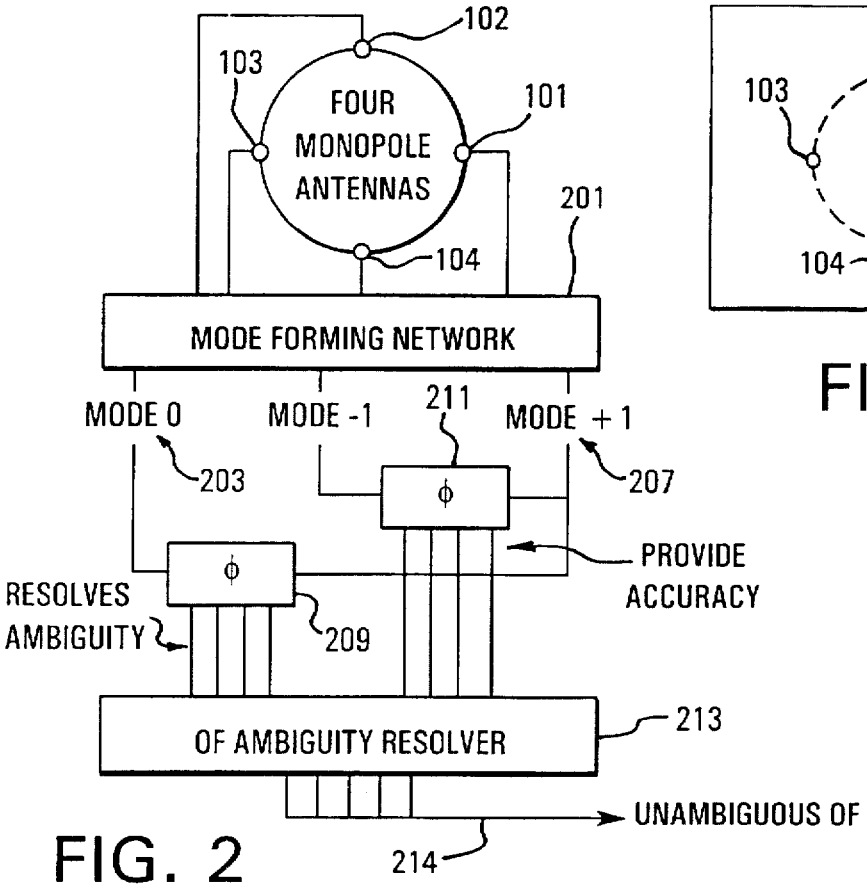
FIG. 2 shows a four element circular monopole array according to the invention.

FIG. 2 shows the four monopole antennas connected to a mode forming network 201. Mode forming network 201, for example a multimode combiner or a Butler matrix, has mode 0, mode−1 and mode +1 outputs, 203, 205 and 207, respectively. A phase difference detector 209 is used to determine the phase difference between mode 0 and mode 1. Phase detector 209 is shown in FIG. 2 to produce phase information quantized to four bits. The four bit quantized phase detection 209 is by way of illustration and not limitation, as it will be known to those of ordinary skill that other phase difference detectors can be employed within the scope of the invention.

Figure 3:
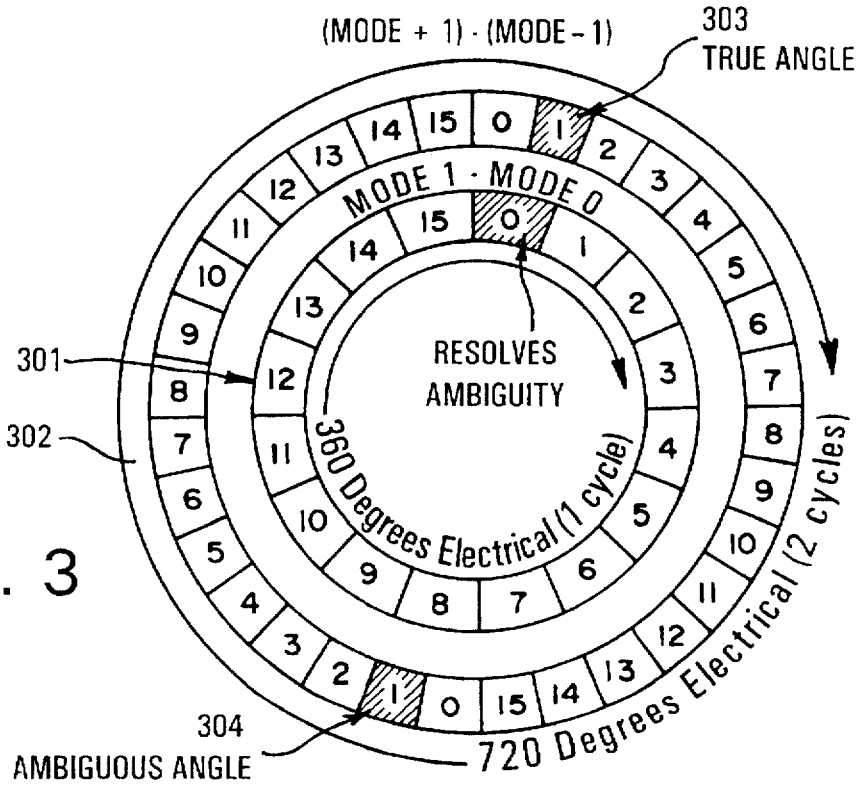
FIG. 3 illustrates accuracy and ambiguity resolution and a four element antenna according to the invention.

FIG. 3 shows circles 301 and 302 for purposes of illustrating that the antenna topology according to the invention, when used with the phase difference detector, can produce a correspondence in phase angle versus spatial azimuth angle around the antenna system. Circle 301 illustrates that the phase difference between mode 0 and mode 1 can be between 0° and 360°. Assuming a four bit quantized output, circle 301 shows 16 cells in 360 electrical degrees. As previously noted, this is merely by way of illustration. A typical system could provide much higher precision by using 9 bit phase quantization resulting in 512 cells per 360° and a cell width of 0.703 electrical degrees.

A further improvement in accuracy can be achieved using the phase difference between mode +1 and mode −1. As indicated by circle 302, the phase difference between mode +1 and mode −1 as determined by phase detector 211 varies through 720° over the antenna coverage area. The fact that the range of phase angle variation is doubled to 720° provides improved accuracy. However, since the phase angle varies over 720 degrees (twice 360 degrees), each phase difference angle appears twice, as shown by true angle 303 and ambiguous angle 304. The ambiguity is resolved by comparing for consistency the phase difference between mode 0 and mode 1 (or mode −1) with the phase difference between mode +1 and mode −1 in the DF ambiguity resolver 213 which produces an unambiguous DF output on signal lines 214.

Figure 4:
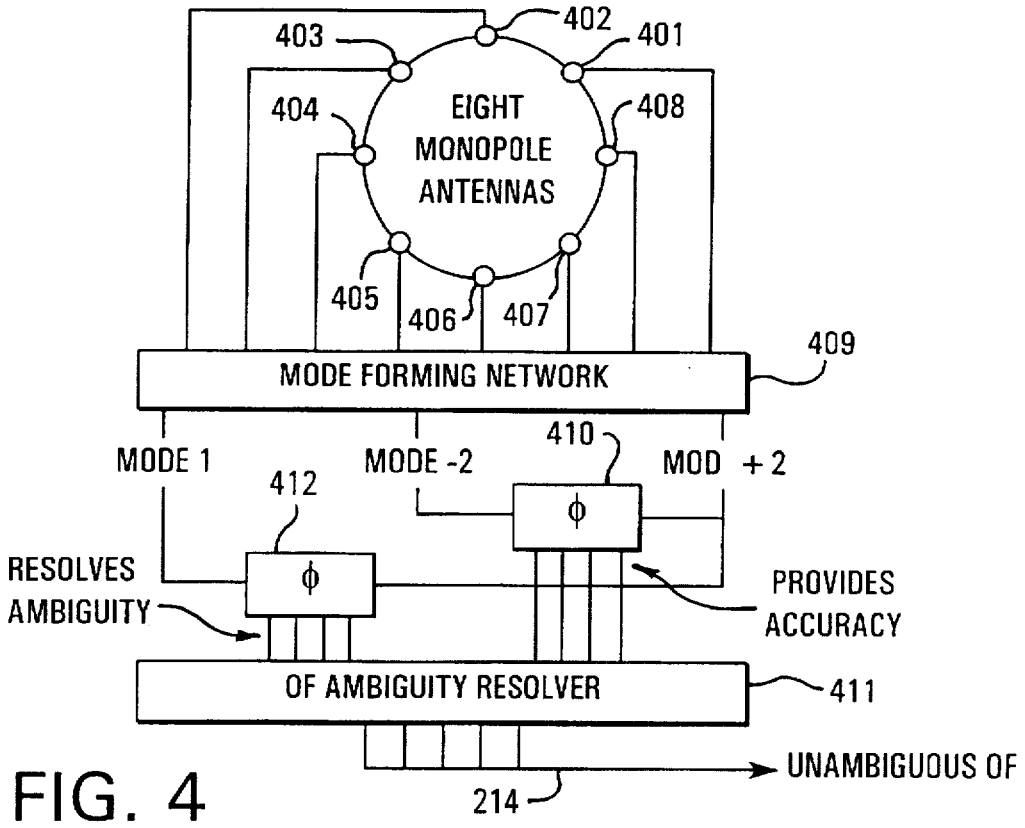
FIG. 4 illustrates an eight element circular monopole array according to the invention.
Figure 5:
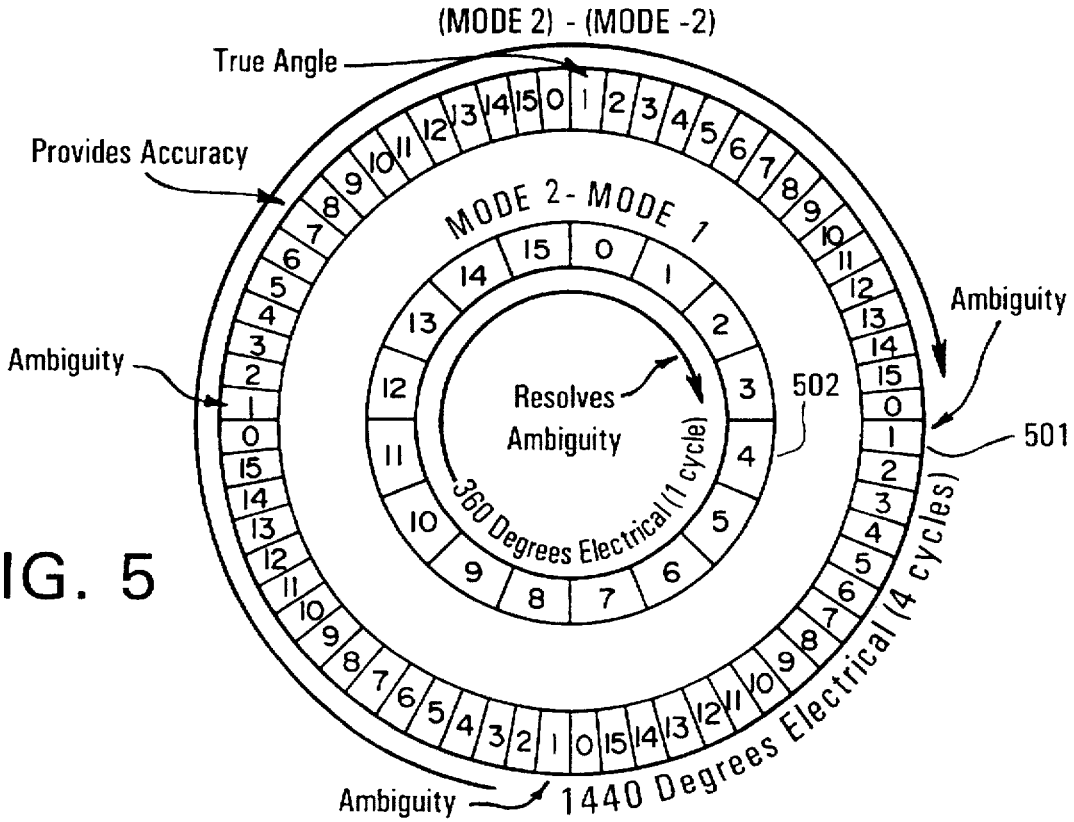
FIG. 5 illustrates accuracy and ambiguity resolution in an eight element monopole array according to the invention.

FIG. 4 illustrates an antenna according to the invention employing an 8 element circular monopole array. Outputs from monopole antennas 401–408 are provided to mode forming network 409. In this case, the mode forming network provides the mode +2 and mode −2 outputs to phase detector 410. Phase detector 410 provides an output to the DF ambiguity resolver 411. The output of phase detector 410 varies through 1440 electrical degrees over the coverage area, as indicated in FIG. 5 by circle 501. This provides high accuracy, but results in the same phase angle at four different locations, thereby producing three ambiguous results. Phase detector 412 is used to resolve the ambiguity by producing a one-for-one correspondence between phase angle and spatial position, as shown by circle 502 in FIG. 5. The ambiguity is resolved in ambiguity resolver 411 by comparing the angles measured by phase detector 410 with the result from phase detector 412 and selecting as the true angle the output from phase detector 410 which is within the wider range of the output of phase detector 412.

Figures 6A, 6B:
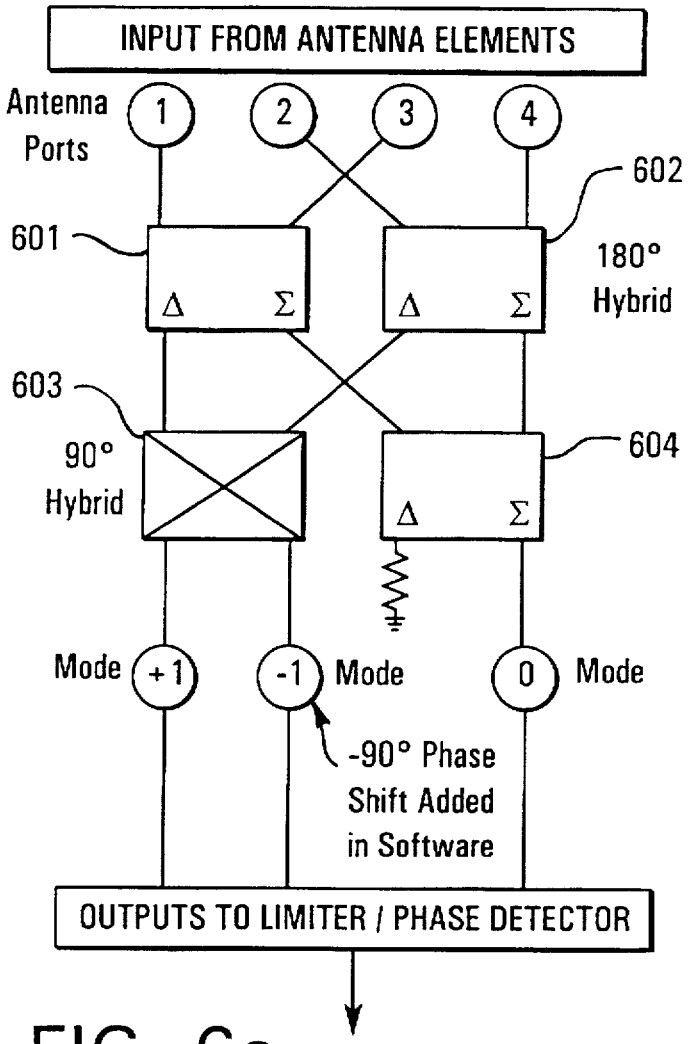
FIG. 6*a* illustrates a mode former for a four element array according to the invention.
FIG. 6*b* shows the phase relationship between modes and antenna ports in a four element antenna according to the invention.

FIG. 6*a* illustrates a mode former for use in a four element antenna system according to the invention. Signals from the antenna elements, such as elements 101–104, are applied through antenna ports to 180° hybrid couplers 601, 602 as shown. The difference outputs from 180° hybrid couplers 601, 602 are applied to a 90° hybrid 603. The outputs of the 90° hybrid 603 provide the mode +1 and mode −1 outputs. Note that the mode −1 output has a −90° phase shift added, for example in software. The sum output from 180° hybrid 602 is applied to 180° hybrid 604 to produce the mode 0 output. The mode +1, −1 and 0 outputs are then provided to phase detectors, as previously discussed. Optimally, the phase detectors may also include limiter circuitry. FIG. 6*b* is a table summarizing the phase shift in degrees for the various modes at the various antenna ports.

Figures 7A, 7B:
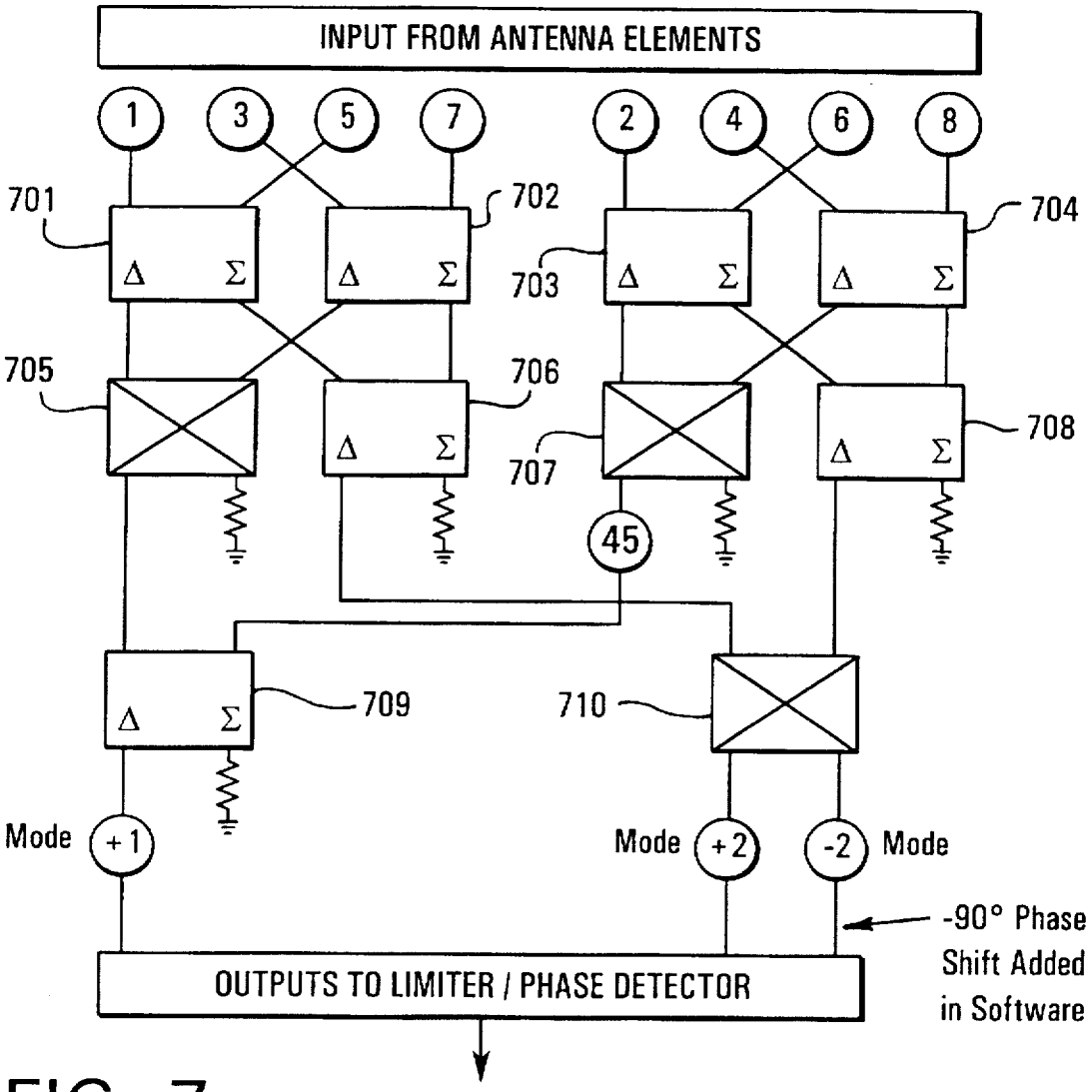
FIG. 7*a* shows a mode former configuration for an eight element antenna according to the invention.
FIG. 7*b* shows the phase relationship between modes and antenna ports in an eight element mode former according to the invention.

FIG. 7*a* illustrates a mode former configuration for an eight element antenna array according to the invention. In this case, signals from antenna elements, such as 401–408, are applied through input ports 1–8 to 180° hybrids 701–704 as shown. The output from these hybrids are applied to 90° hybrids 705, 707 and 180° hybrid 706, 708 as shown. A mode 1 output is provided from the sum port of 180° hybrid 709, while the +2 and −2 modes are provided as outputs from the 90° hybrid 710, with −90° phase shift added, for example, in software to the mode −2 output. FIG. 7*b* illustrates the phase shift in degrees for the various modes and antenna ports.

In the four element antenna system described above, the phase detector is configured to determine the phase difference between a reference and mode +1 or mode −1. In this case, the reference used is the mode 0 output. However, the mode 0 output can also be obtained from an omni-directional antenna element, such as a dipole located at the center of the circular ground plane formed by the monopole elements disposed approximately symmetrically at 0°, 90°, 180° and 270°. Such an omni-directional element is shown as element 105 in FIG. 1.

Figure 8:
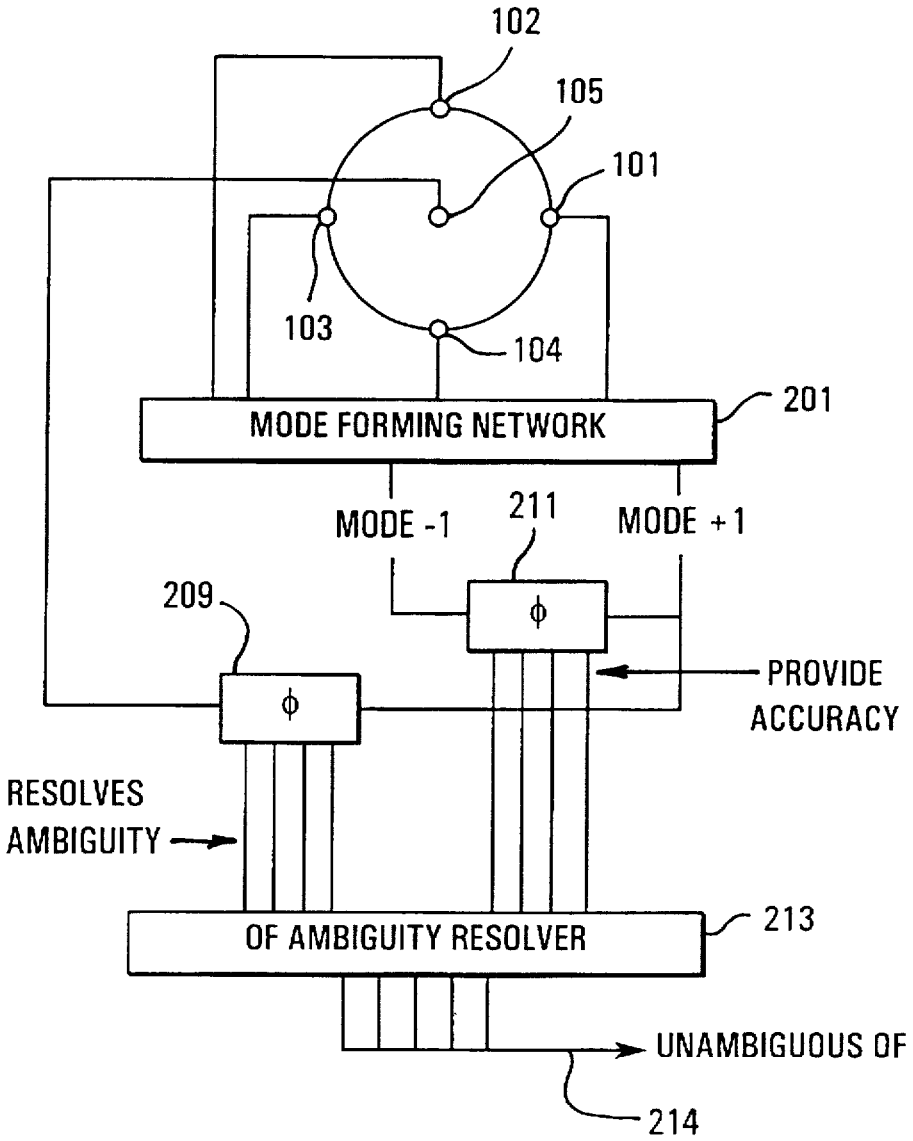
FIG. 8 shows a circular monopole array according to the invention using a centrally located omnidetector to provide mode 0.

FIG. 8 shows the antenna connections to the mode forming network and phase detectors in this configuration.

Figure 9:
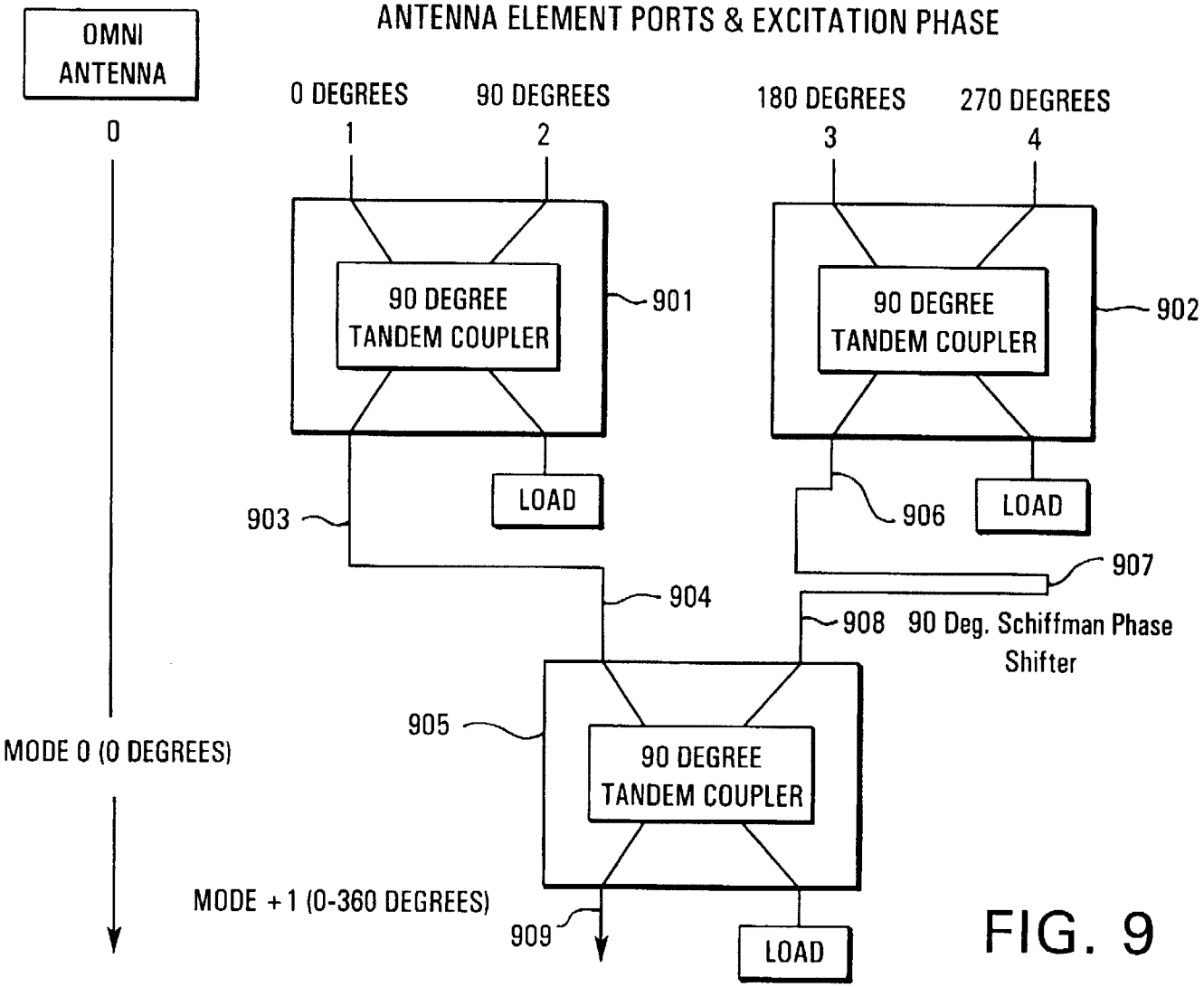
FIG. 9 shows a stripline mode former useful at 18 GHz to 40 GHz in an antenna according to the invention.

FIG. 9 shows a mode former which can be printed on a single low loss substrate in a stripline fashion to reduce phase losses and maintain phase track tolerance in the 18 GHz to 40 GHz frequency range. In this case, an omni-antenna element, such as antenna element 105, is used to provide the mode 0 output. Signals from antenna elements 101–104 located at 0°, 90°, 180° and 270°, respectively are applied to antenna ports 1–4 as shown in FIG. 9. Two of the ports are routed to 90° tandem coupler 901, while the remaining ports are routed to 90° tandem coupler 902. One of the outputs of each tandem coupler is loaded. Output 903 of tandem coupler 901 is routed directly to an input terminal 904 of tandem coupler 905. Output 906 of tandem coupler 902 is routed to a 90° Schiffman phase shifter 907. The output of the phase shifter is provided to input 908 of 90° tandem coupler 905. Output 909 of 90° tandem coupler 905 provides the mode +1 output, while the remaining output terminal of tandem coupler 905 is loaded.

Figure 10:
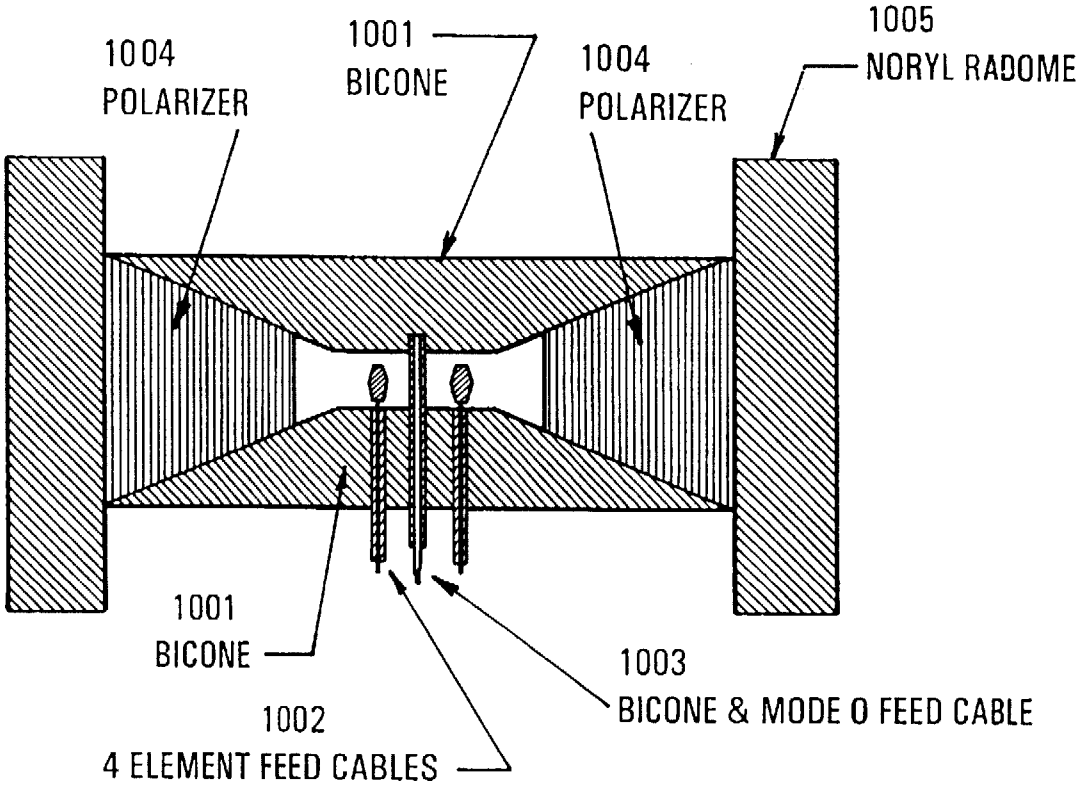
FIG. 10 shows an 18 GHz to 40 GHz antenna configuration according to the invention.

FIG. 10 illustrates an antenna system according to the invention for use in the 18 GHz to 40 GHz range. The antenna includes bicone 1001 surrounding the antenna elements which provide signals to the mode former through feed cable 1002 and 1003. The antenna also includes polarizer 1004 and a radome, such as a noryl radome 1005.

According to the invention, monopole elements arranged symmetrically on a ground plane and connected to a mode forming network and phase detector as previously described herein can be positioned within a bicone to provide broadband performance. A bicone acts as a horn antenna, which can be configured to operate over a 3:1 bandwidth. The bicone also provides volume for placing the mode forming network inside. Since monopole elements are not inherently broadband, positioning the array of elements in a bicone improves performance. The mode former and phase detector and ambiguity resolver can also be placed in the bicone.

Figure 11A:
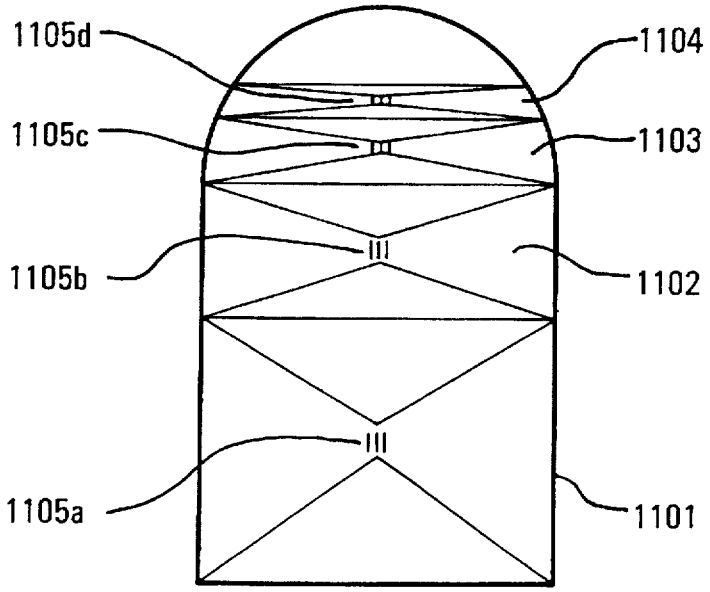
FIGS. 11*a* and 11*b* show a plurality of vertically stacked antennas to provide broadband coverage according to the invention.
Figure 11B:
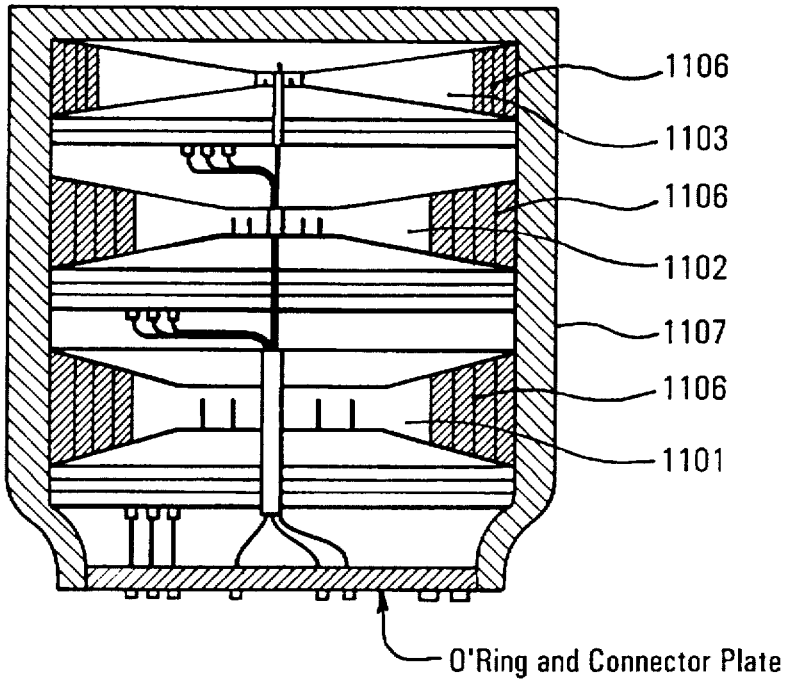

According to the invention, bicones can also be stacked vertically as shown in FIGS. 11*a* and 11*b*. A broader band of coverage can be achieved according to the invention by vertically stacking (for example, in a manner resembling a wedding cake) a plurality of bicones, e.g., 1101–1104, each with a plurality of monopole feed elements 1105*a*–1105*d* disposed between the bicone elements at the same radial distance from a center of a ground plane. Each antenna would have a mode former to which the plurality of feed elements is connected, as previously discussed herein. Vertically stacking a plurality of such antennas provides DF accuracy over a broad frequency range, since each antenna is designed to accommodate a particular frequency range. For example, antennas 1101–1104 could cover ranges from 0.5 GHz to 2.0 GHz, 2.0 GHz–6.0 GHz, 6.0 GHz–18.0 GHz and 18.0 GHz to 40.0 GHz, respectively.

Figure 12:
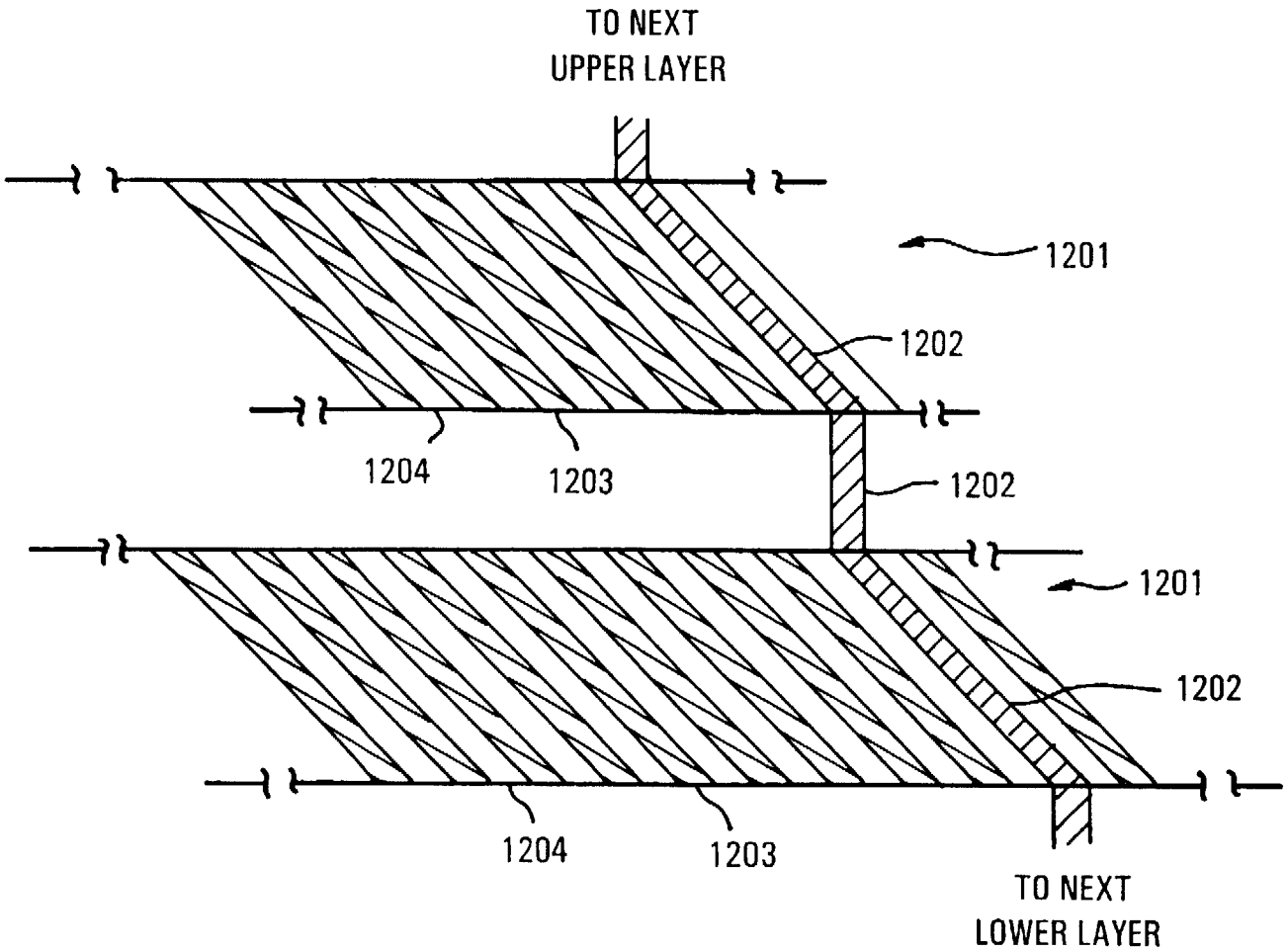
FIG. 12 illustrates a feed cable mounted on a polarizer to connect vertically stacked antennas according to the invention.

In another feature according to the invention, the feed cable (typically coaxial cable) is wrapped outside the bicone, for example on the polarizer 1106, for each antenna above another on the vertical stack within the radome 1107. For example, a 45 degree slant polarizer 1201, as shown in FIG. 12, is preferred for each antenna, since this polarizer assures detection of both horizontally and vertically polarized signals. In this case, the coaxial cable 1202 either replaces one of conductors 1203 of the polarizer grid 1204 or is mounted on top of a conductor, such that the coaxial feed cable parallels one of the conductors of an antenna's polarizer grid as the feed cable is routed to the antenna above it in the stack. This arrangement of the feed cable has the advantage of eliminating the need for routing the cable through the center of the antenna elements in each array. As a result, phase errors are reduced and, because the monopole elements can be placed closer together, far field errors are reduced.

The antenna according to the invention eliminates the need to have a channel for each sector of antenna coverage and provides omnidirectional, monopole DF with reduced system complexity. For example, a four element array requires only three channels (mode 0, mode +1 and mode −1) while a five element array with an omnidirectional element producing the reference requires only two channels, as shown in FIG. 9. Further the measured azimuth is independent of elevation and frequency. The use of a phase comparison technique in a structure according to the invention also is more accurate than amplitude comparison.

While several embodiments of the invention have been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. An antenna system comprising:

a plurality of monopole elements disposed symmetrically around a center of a circular ground plane, the axis of each of said monopole elements being substantially vertical and at a same radial distance from said center;

a multimode combiner connected to said monopole elements to provide a plurality of mode outputs;

at least one phase difference detector configured to determine phase differences between selected ones of said mode outputs.

2. An antenna system as recited in claim 1, wherein said phase difference detector produces a correspondence between phase angle versus spatial azimuth angle around said antenna system.

3. An antenna system as recited in claim 2, comprising a first phase difference detector connected to determine a first phase difference, said first phase difference being a phase difference between a phase reference and a first of said selected mode outputs.

4. An antenna system as recited in 3, wherein said phase reference is a second of said selected mode outputs.

5. An antenna system as recited in claim 3, comprising a second phase difference detector connected to determine a second phase difference, said second phase difference being a phase difference between others of said mode outputs.

6. An antenna system as recited in claim 5, wherein said second phase difference is a phase difference between said first mode output and said second mode output.

7. An antenna system as recited in claim 5, further comprising an ambiguity resolver connected to receive outputs from said first and second phase difference detectors, said ambiguity resolver comparing for consistency phase differences determined by each of said first and second phase difference detectors and outputting an unambiguous phase angle signal indicative of azimuth of a detected object.

8. An antenna system as recited in claim 7, wherein said ambiguity resolver selects as said unambigous phase angle, an output from said second phase difference detector which is within a wider range output from said first phase difference detector.

9. An antenna system as recited in claim 8, wherein said first and second phase difference detector outputs define sectors representing said azimuth.

10. The antenna system recited in claim 3, wherein:

said plurality of monopole elements comprises elements at least disposed at about 0°, 90°, 180° and 270° respectively on a said circular ground plane;

said multimode combiner is connected to said monopole elements to provide at least a mode 0 output, a mode +1 output and a mode −1 output; and said first phase difference detector is configured to determine a phase difference between said phase reference and one of said mode +1 output and said mode −1 output.

11. An antenna system as recited in claim 10, wherein said phase reference is said mode 0 output.

12. An antenna system as recited in claim 10, further comprising a central monopole element located at said center of said circular ground plane.

13. An antenna system as recited in claim 12, wherein said phase reference is said central monopole element.

14. An antenna system as recited in claim 10, comprising a second phase difference detector determining a difference in phase between said mode +1 output and said mode −1 output.

15. An antenna system as recited in claim 14, further comprising an ambiguity resolver connected to receive outputs from said first and second phase difference detectors, said ambiguity resolver comparing for consistency phase differences determined by each of said first and second phase difference detectors and outputting an unambiguous phase angle signal indicative of azimuth of a detected object.

16. An antenna system as recited in claim 15, wherein said ambiguity resolver selects as said unambigous phase angle, an output from said second phase difference detector which is within a wider range output from said first phase difference detector.

17. An antenna system as recited in claim 15, further comprising a biconical horn, said plurality of monopole elements being located within said biconical horn.

18. An antenna system as recited in claim 10, further comprising a biconical horn, said plurality of monopole elements being located within said biconical horn.

19. An antenna system as recited in claim 16, wherein said first a nd second phase difference detector outputs define sectors representing said azimuth.

20. An antenna system as recited in claim 3, wherein:

said plurality of monopole elements comprises at least eight elements;

said multimode combiner is connected to said monopole elements to provide at least a mode +1 output, a mode +2 output and a mode −2 output; and said first phase difference detector is configured to determine a phase difference between said phase reference and one of said mode +2 output and said mode −2 output.

21. An antenna system as recited in claim 20, wherein said phase reference is said mode +1 output.

22. An antenna system as recited in claim 21, comprising a second phase difference detector determining a difference in phase between said mode +2 output and mode −2 output.

23. An antenna system as recited in claim 22, further comprising an ambiguity resolver connected to receive outputs from said first and second phase difference detectors, said ambiguity resolver comparing for consistency phase differences determined by each of said first and second phase difference detectors and outputting an unambiguous phase angle signal indicative of azimuth of a detected object.

24. An antenna system as recited in claim 23, wherein said ambiguity resolver selects as said unambigous phase angle, an output from said second phase difference detector which is within a wider range output from said first phase difference detector.

25. An antenna system as recited in claim 24, wherein said first and second phase difference detector outputs define sectors representing said azimuth.

26. An antenna system as recited in claim 23, further comprising a biconical horn, said plurality of monopole elements being located within said biconical horn.

27. An antenna system as recited in claim 20, further comprising a biconical horn, said plurality of monopole elements being located within said biconical horn.

28. An antenna system as recited in claim 1, further comprising a biconical horn, said plurality of monopole elements being located within said biconical horn.

29. An antenna as recited in claim 28, wherein said biconical horn comprises a pair of bicone elements.

30. An antenna system as recited in claim 28, further comprising a polarizer.

31. An antenna system as recited in claim 1, wherein said multimode combiner comprises a mode former having three 90° tandem couplers.

32. An antenna system as recited in claim 31, a first of said tandem couplers being connected to receive an output from selected ones of said monopole elements and having an output connected to provide a signal to one of two inputs of a third of said tandem couplers, a second of said tandem couplers being connected to receive an output from others of said monopole elements and having an output connected to provide a signal to a second of said inputs to said third tandem coupler, said third tandem coupler having a terminal producing a desired mode output.

33. An antenna system as recited in claim 32, further comprising a biconical horn, said plurality of monopole elements being located within said biconical horn.

34. An antenna system as recited in claim 31, a first of said tandem couplers being connected to receive an output from ones of said monopole elements disposed at about 0° and 90° and having an output connected to provide a signal to one of two inputs of a third of said tandem couplers, a second of said tandem couplers being connected to receive an output from ones of said monopole elements disposed at about 180° and 270° and having an output connected to provide a signal to a second of said inputs to said third tandem coupler said third tandem coupler having an terminal producing a mode +1 output.

35. The antenna system recited in claim 34, wherein said second tandem coupler provides its output to said third tandem coupler through a 90° phase shifter.

36. The antenna system recited in claim 35, wherein said mode former is printed on a single low loss substrate.

37. The antenna system recited in claim 36, wherein said mode former is printed in a stripline arrangement such that said outputs of said elements do not cross over each other.

38. An antenna system comprising:

a pair of bicone elements;

four antenna elements disposed between said bicone elements, at a same radial distance from the center of a ground plane at about 0°, 90°, 180° and 270° with respect to said ground plane;

a bicone feed element located at said center, said bicone element producing a mode 0 output;

a mode former connected to said four antenna elements to produce a mode +1 output.

39. The antenna system recited in claim 38, wherein said four antenna elements are monopole elements.

40. The antenna system recited in claim 38, further comprising polarizers disposed between portions of said bicone elements and around said antenna elements.

41. The antenna system recited in claim 40, said antenna system being tuned to operate in a frequency range from about 18 GHz to about 40 GHz.

42. The antenna system recited in claim 38, wherein said mode +1 output from said mode former and said mode 0 output from said bicone feed element provide a correspondence in phase angle versus spatial azimuth angle around said system for the purpose of performing passive direction-finding.

43. The antenna system recited in claim 42, wherein said mode former comprises three tandem couplers.

44. The antenna system recited in claim 43, a first of said tandem couplers being connected to receive an output from said antenna elements disposed at 0° and 90° and having an output connected to provide a signal to one of two inputs of a third of said tandem couplers, a second of said tandem couplers being connected to receive an output from said antenna elements disposed at about 180° and 270° and having an output connected to provide a signal to a second of said inputs to said third tandem coupler said third tandem coupler having an terminal producing said +1 output.

45. The antenna system recited in claim 44, wherein said second tandem coupler provides its output to said third tandem coupler through a 90° phase shifter.

46. The antenna system recited in claim 45, wherein said mode former is printed on a single low loss substrate.

47. The antenna system recited in claim 46, wherein said mode former is printed in a stripline arrangement such that said outputs of said elements do not cross over each other.

48. The antenna system recited in claim 47, said antenna system being tuned to operate in a frequency range from about 18 GHz to about 40 GHz.

49. An antenna system comprising:

a plurality of vertically stacked antennas, each one of said plurality having:

a pair of bicone elements and a plurality of monopole antenna elements disposed between said bicone elements on a ground plane at a same radial distance from a center of said ground plane;

a mode former connected to said feed elements to produce selected mode outputs; and a phase difference detector for detecting differences in phase between selected ones of said mode outputs.

50. The antenna recited in claim 49, wherein each of said plurality of vertically stacked antennas covers a different frequency range.

51. The antenna recited in claim 50, wherein said plurality of vertically stacked antennas covers a frequency range of at least 2.0 GHz to 40.0 GHz.

52. The antenna recited in claim 49, wherein each of said plurality of vertically stacked antennas further comprises a polarizing grid.

53. The antenna recited in claim 52, wherein at least some of said vertically stacked antennas are connected by a feed cable mounted on said polarizing grid.

54. The antenna recited in claim 53, further comprising a radome enclosing said vertically stacked antennas.

55. An antenna system comprising:

a plurality of vertically stacked antennas, at least one of said plurality having:

a pair of bicone elements and a plurality of feed elements disposed between said bicone elements at a same radial distance from a center of ground plane at least at about 0°, 90°, 180° and 270°;

a bicone feed element at said center of said one; and a mode former connected to said feed elements to produce a mode +1 output.

56. The antenna system recited in claim 55, wherein each one of said plurality of antennas is configured to cover a different band of frequencies.

57. The antenna system recited in claim 56, wherein said plurality comprises antennas covering a total range of about 0.5 GHz to 40 GHz.

58. A mode former receiving outputs from monopole antenna elements symetrically disposed on a groundplane, said mode former comprising at least three tandem couplers, a first of said tandem couplers being connected to receive an output from ones of said monopole elements disposed at about 0° and 90° and having an output connected to provide a signal to one of two inputs of a third of said tandem couplers, a second of said tandem couplers being connected to receive an output from ones of said monopole elements disposed at about 180° and 270° and having an output connected to provide a signal to a second of said inputs of said third tandem coupler said third tandem coupler having a terminal producing a mode +1 output.

59. The mode former recited in claim 58, wherein said second tandem coupler provides its output to said third tandem coupler through a 90° phase shifter.

60. A mode former as recited in claim 59, wherein said mode former is printed on a single low loss substrate.

61. A mode former as recited in claim 60, wherein said mode former is printed in a stripline arrangement such that said outputs of said elements do not cross over each other.

* * * * *